US005560617A

United States Patent [19]

Liang

[11] Patent Number: 5,560,617

[45] Date of Patent: Oct. 1, 1996

[54] DARTBOARD WITH A SEPARATE CONTROL PANEL DEVICE

[76] Inventor: Tu-Hsien Liang, No. 3 Alley 28, Lane 305, Chung Chen Rd., Pan Chiao City, Taipei Shian, Taiwan

[21] Appl. No.: 389,018

[22] Filed: Feb. 15, 1995

[51] Int. Cl.[6] ..... F41J 5/02

[52] U.S. Cl. ..... 273/376; 273/371; 364/411

[58] Field of Search ..... 273/85 G, 376, 273/371, 348, 378, 408, 403, 404, 409, 148 B; 364/410

[56] References Cited

U.S. PATENT DOCUMENTS

| | | | |
|---|---|---|---|
| 4,415,162 | 11/1983 | Sheppard | 273/371 |
| 5,020,806 | 6/1991 | Martin | 273/371 |
| 5,039,977 | 8/1991 | Mele et al. | 273/371 X |
| 5,156,643 | 10/1992 | Grubek | 273/376 |
| 5,338,032 | 8/1994 | Latham | 273/371 X |
| 5,366,230 | 11/1994 | Sanquinetti-Trigo | 273/371 |

FOREIGN PATENT DOCUMENTS

| | | | |
|---|---|---|---|
| 2185896 | 8/1987 | United Kingdom | 273/371 |

*Primary Examiner*—Jessica J. Harrison
*Assistant Examiner*—Michael O'Neill
*Attorney, Agent, or Firm*—Bucknam and Archer

[57] ABSTRACT

A dartboard with a separate control panel device comprises a control panel device which is independent of the dartboard portion. A transmitter of infrared or of radio is provided on a switch circuit board in the dartboard portion and a receiver of infrared or of radio is provided on a circuit board in the control panel device corresponding to the transmitter. When one of target plates is hit to move backward and touch activated switches because of the dart impulse, a positional signal is generated. The positional signal is then converted to a group of data signals in the transmitter and sent to the receiver through a transmitting element or a wave oscillation element. The group of data signals which are received by a receiving circuit in the control panel device is then converted into scores and shown on displays. Besides, a card slot for scoring software cards, a dry cell seat and a recharger are also provided in the control panel device respectively for players having multiple choice of scoring ways and a selection of playing locations either indoors or outdoors.

6 Claims, 6 Drawing Sheets

DARTBOARD WITH A SEPARATE CONTROL PANEL DEVICE

The present invention relates to a dartboard with a separate control panel device, and more precisely, relates to a dartboard in which the control panel device is independent of the dartboard itself and can be placed at a proper location near to the players.

BACKGROUND OF THE INVENTION

A dartboard is an amusement tool with which darts are thrown at a target and a score can be counted based on a specific area of the target struck by darts. The U.S. Pat. No. 5,193,817 granted to Francis Pan disclosed a dartboard which is able to count scores automatically once any one of the target plates is struck and moves rearward to touch membrane switches in a scoring register integrated with the dartboard. It is also known that a circuit board provided in the scoring register electrically connects the membrane switches so that a score computing and a score displaying job can be carried out.

The prior art dartboard still involves unavoidable disadvantages which are summarized and listed hereinbelow.

(1) A proper distance has to be kept between the dartboard hanging on a wall and the throwing spot during the dart game, and it is hard for players to read scores displayed on the dartboard clearly;

(2) The scoring register integrated with the dartboard is likely to be struck by darts and result in damage; and (3) Once the switch buttons on the dartboard are struck by darts unintentionally, the scores shown on the dartboard will disappear or unexpected scores will be displayed.

SUMMARY OF THE INVENTION

The crux of the present invention resides in the fact that a dartboard has a control panel device which is separated from the dartboard itself. Basically, a positional signal is generated by means of a target plate pushing activated switches located in the dartboard and a transmitter of infrared or radio is introduced to convert the positional signal into a group of data signals and then sends out a group of data signals. A receiver of infrared or radio which is provided in the control panel device independent of the dartboard receives the group of signals and converts the group of signals into scores through an electronic circuit along with a function of a sound pronouncing or a score reporting. In addition, a card slot is provided in the control panel device for inserting a variety of scoring software cards alternatively to enhance the amusing effect of the dart game. Furthermore, a dry cell and a recharger are equipped in the control panel device so that the game can be played either indoors or outdoors.

An object of the present invention is to provide a dartboard with a separate control panel device in which the infrared or radio transmission is introduced so that the control panel device can be placed near to the players to ease the operation of control switches and the reading of scores.

Another object of the present invention is to provide a dartboard with a separate control panel device with which it is impossible for players to strike and damage the control panel device unintentionally.

A further object of the present invention is to provide a dartboard with a separate control panel device on which the switch buttons cannot be hit by darts so that a cancellation of scores or an unexpected score display will be avoided and there will not be interference with the entertainment atmosphere.

A further object of the present invention is to provide a dartboard with a separate control panel device in which a card slot is offered for alternatively locating a variety of scoring software cards as desired to promote playing interest and enhance an amusing effect.

A further object of the present invention is to provide a dartboard with a separate control panel device in which a dry cell and a recharger are also equipped so that the dart game can be played either indoors or outdoors.

BRIEF DESCRIPTION OF THE DRAWINGS

The present invention will be further described in detail, by way of example, with reference to the accompanying drawings in which.

DETAILED DESCRIPTION OF THE PREFERRED EMBODIMENTS

Figure 1:
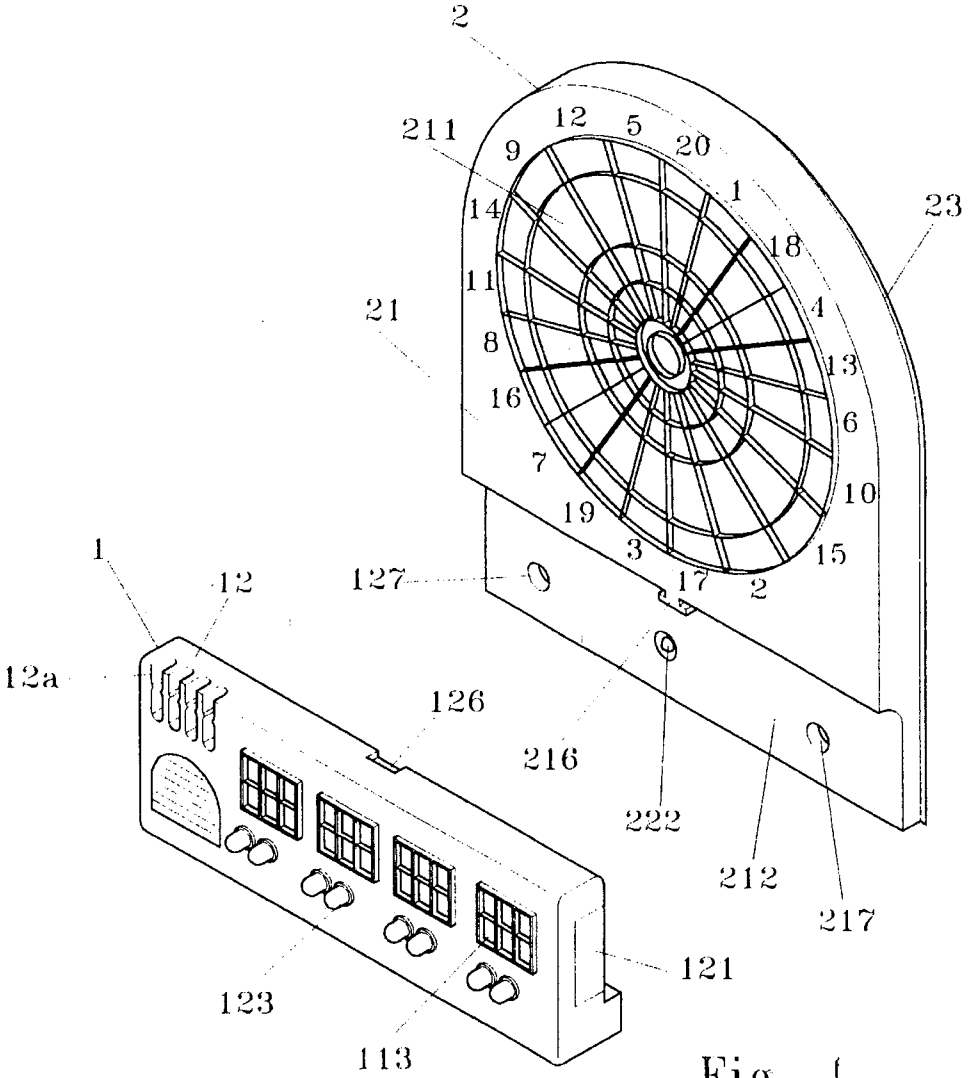
FIG. 1 is a perspective view showing a first preferred embodiment of the present invention.

By reference to FIG. 1, a dartboard with a separate control panel device according to the present invention consists of a dartboard portion 2 and a control panel device 1 in which the control panel device 1 is independent of the dartboard portion 2 and can be placed near players so that it is easy for players to operate switch buttons and read scores clearly. It can be understood that the dartboard portion 2 separated from the control panel device 1 is an arrangement completely different from the prior art dartboard. Basically, a circular target area surrounded with basic numerical marks on a front panel 21 of the dartboard 2 is apparently not different from any prior art dartboard. A central hole located in the lower part of the front panel 21 is fitted with an infrared transmitting element 222 so that data signals can be sent to a receiver in the control panel device 1 when any one of target plates in the target area is hit by a dart and moves to touch activated switches in the dartboard portion. The control panel device 1 and the dartboard portion 2 are capable of being separated into two independent parts because of the application of infrared transmission. A much more detailed description about the dartboard portion 2 and the control panel device 1 will follow.

Figure 2:
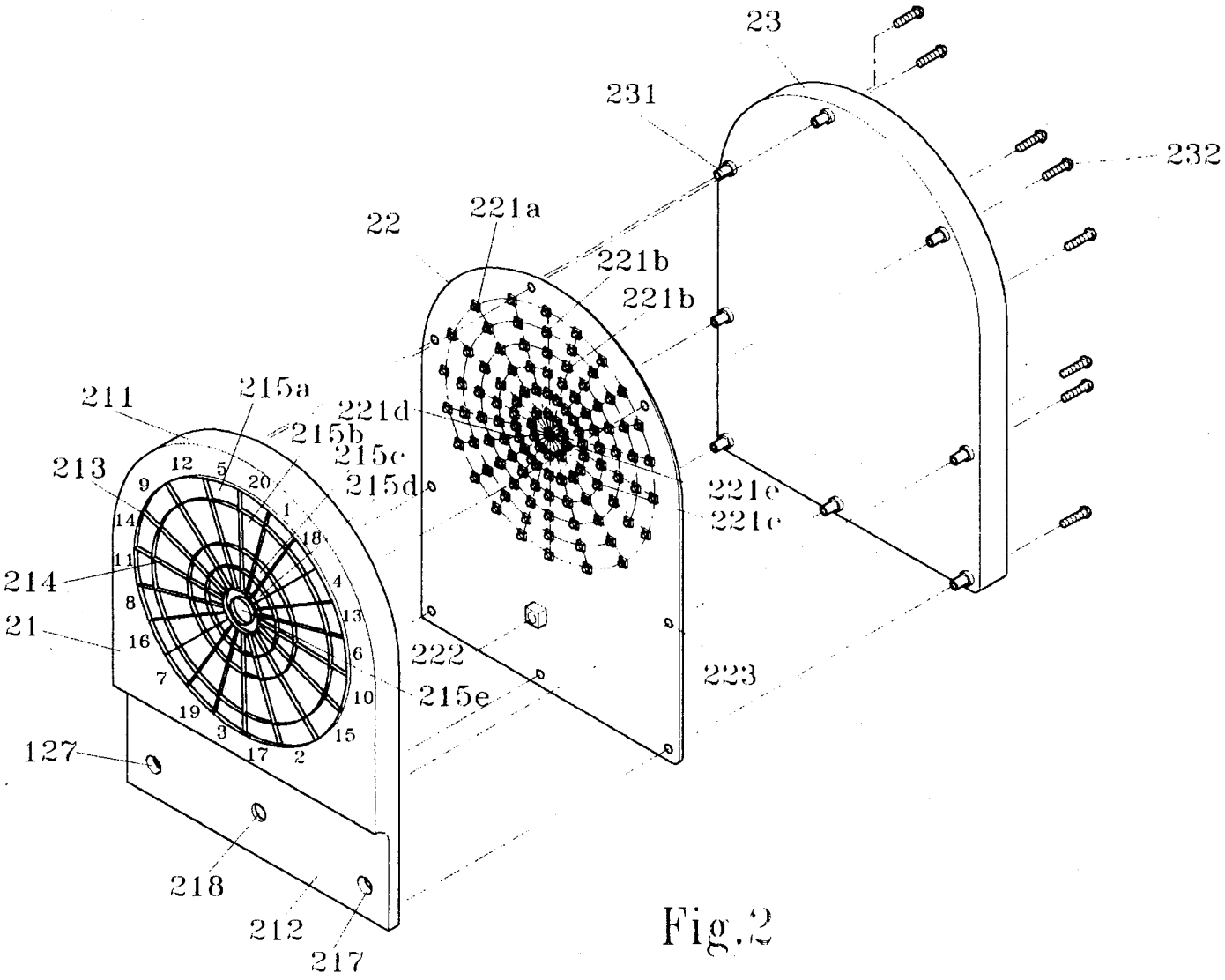
FIG. 2 is a disassembled perspective view of a dartboard portion shown in FIG. 1.

Referring to FIG. 2 in addition to FIG. 1, the dartboard portion 2 primarily consists of a front panel 21, a switch circuit board 22 and a rear cover board 23. The front panel 21 is a casing plate with a semi-circular top 211 and a lower recession part 212. The target area of the front panel 21 is formed in accordance with any prior art dartboard in which a plurality of annular partitions 213 and a plurality of angularly spaced radial partitions 214 connect with one another to constitute a plurality of spaces in different size so that a plurality of target plates corresponding with these spaces can be fitted into these spaces respectively. A number of basic numerical marks which surround the target area are also provided on the front panel 21 as in any conventional dartboard. The switch circuit board 22 is a plate having the same outline as the front panel 21 but a smaller area. A plurality of activated switches are provided on the switch circuit board 22 corresponding to the plurality of target plates respectively so that these activated switches are aligned annularly and radially. We can see on the circuit board 22 that the outermost target plates 215*a* correspond to outermost activated switches 221*a*, and the outer target plates 215*b* correspond to two outer activated switches 221*b*. By the same token, inner target plates 215*c* and 215*d* and the central target plate 215*e* correspond to inner activated switches 221*c*, 221*d* and 221*e* respectively.

Figure 3:
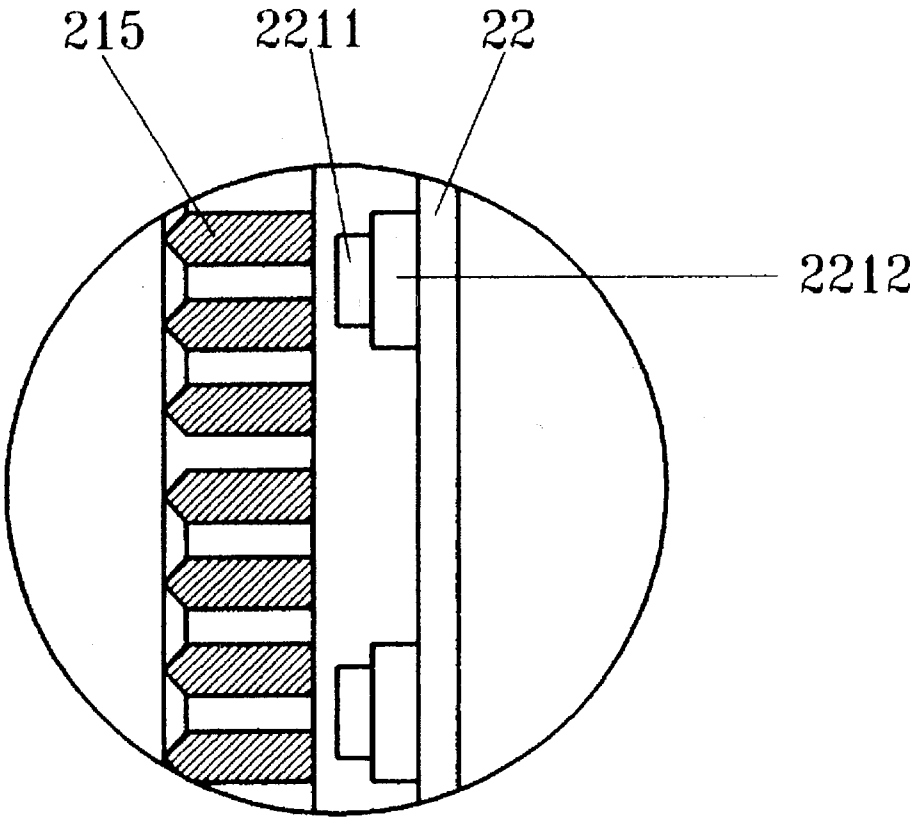
FIG. 3 is an enlarged partial section view of a target plate and the switch circuit board shown in FIG. 2 to illustrate activated switches in the state when they are not touched by the target plate.
Figure 4:
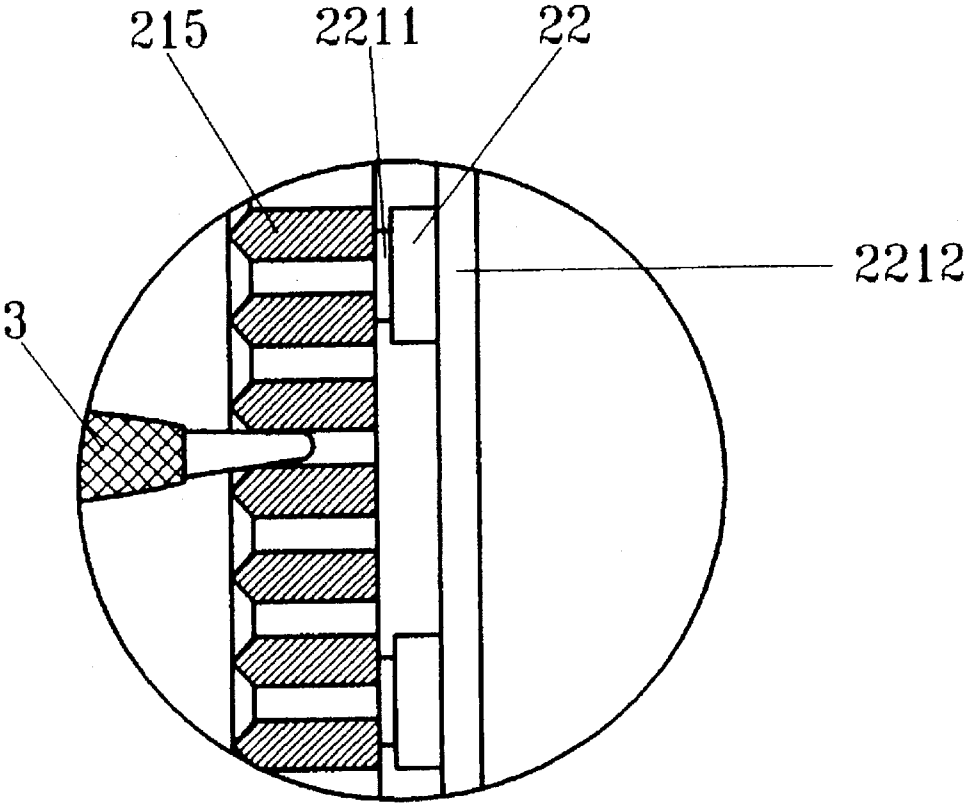
FIG. 4 is a sectional view similar to FIG. 3 to illustrate activated switches when they are touched by the target plate.

Referring to FIG. 3 and FIG. 4, each activated switch 221 on the circuit board 22 is of push button type and comprises a button piece 2211 and a base seat 2212. Each target plate 215 has a flat rear surface and there is a clearance between the target plate 215 and the button piece 2211 while the target plate 215 has not been hit by a dart yet as in the state shown in FIG. 3. The target plate 215 is pushed to move backward and touch the button piece 2211 so that the activated switch 221 is on at this moment while a dart is hitting the target plate 215. It is noted that the push type of activated switches adopted here is only an example, that is, other types of prior art activated switches with an identical function also can be used.

By reference to FIG. 2 again, each activated switch is electrically connected with related circuits on the switch circuit board 22 wherein a transmitting circuit of infrared is connected with the transmitting element 222 located in lower central part of the circuit board 22. Once activated switches are pushed on, a positional signal is generated and the transmitting circuit converts the positional signal into a group of data signals so that the transmitting element 222 can send out the group of data signals. The transmitting element 222 has a cubic appearance and a rectangular recess (not shown) with a central hole 218 provided in the central location of the lower part 212 in the rear side of the front panel 21 for fitting with the transmitting element 222. The rear cover board 23 has the same outline as the front panel 21 and is provided with a plurality of spaced guide holes 231 extending forward to correspond with a plurality of spaced through holes 223 near the edge of the switch circuit board 22 so as to assemble the switch circuit board 22 and the rear cover board 23 together with the front panel 21 by set screws 232. Furthermore, two through holes 217 which are located in a proper place respectively near either lateral edge of the lower part 212 also fit with the control panel device 1 while carrying the whole set of the dartboard.

Figure 5:
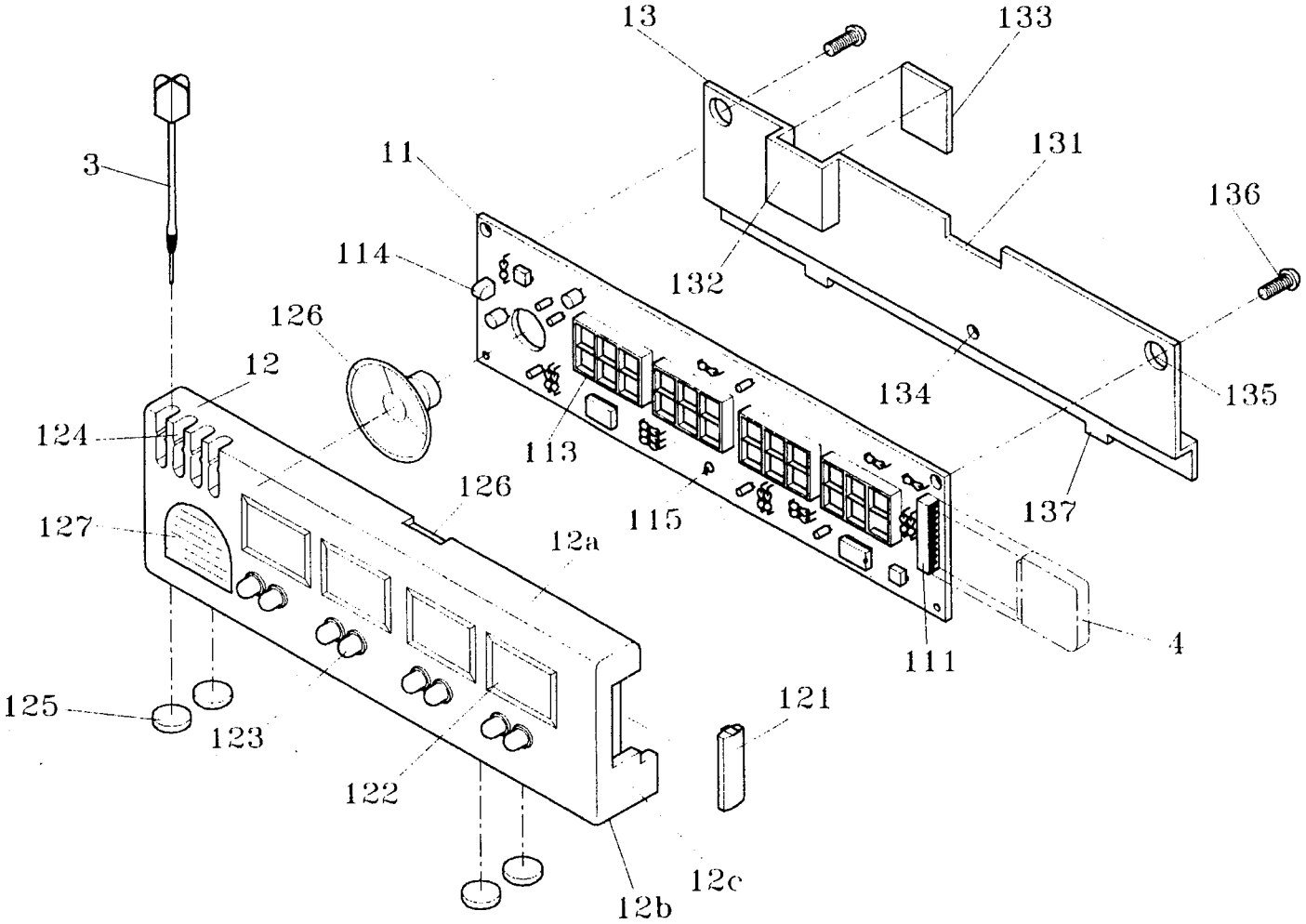
FIG. 5 is a disassembled perspective view of the control panel device shown in FIG. 1.

Referring to FIG. 5 in association with FIG. 1, the control panel device 1 primarily consists of a control panel 12, a circuit board 11 and a back cover plate 13. The control panel 12 has an upper cover 12*a* and a base cover 12*b* which extend rearward respectively. A plurality of display openings 122, a plurality of switch buttons 123, a dart rack 124 and a voice outlet 127 are provided on the control panel 12 at a proper location respectively. A central groove 126 is located in the rear edge of the upper cover 12*a* for receiving a central hanger tongue 216 projecting downward from the upper margin of the lower recess part 212 on the front panel 21 so that the dartboard portion 2 and the control panel device 1 can be coupled with each other as a portable set for easy carry. A plurality foot pads 125 are provided in the base cover 12*b* near both sides respectively. In addition to those prior art parts such as a plurality of display elements 113, a voice driving element, a voice generating element, a scoring element, a loudspeaker 112 and related circuit with electronic components, a receiver circuit of infrared with a receiving element 115 is provided on the circuit board 11 specifically so that data signals sent out from the dartboard portion 2 can be received. A card slot 111 is located at the right position on the circuit board 11 to load a scoring software card 4 up as desired. It is noted that because there are a variety of scoring software cards 4 offered, it is easy for players to have a dart game with a specific scoring way by means of inserting a desired software card 4 into the card slot 111 and an amusing effect will be enhanced. A recharging circuit and a direct current socket 114 are also provided at the left position on the circuit board 11 for power supply. When the circuit board 11 is assembled with the control panel 12, the display elements 113 on the circuit board 11 are flush with the control panel 12 so that a space between the circuit board 11 and the control panel 12 is enough for receiving the card slot 111 and the inserted scoring software card 4. A right end plate 12*c* of the control panel 12 is provided with a groove for the software card 4 moving through while inserting into the card slot. The back cover plate 13 has a rearward bend near the lower edge to enclose the right end plate 12*c* and the left end plate (not shown) which have a respective lower part extending rearward. A central groove 131 is provided on the upper edge of the back cover plate 13 corresponding to the groove 126 on the control panel 12 to allow the hanger tongue 216 passing through while the dartboard portion 2 is coupled with the control panel device 1 as a portable set. A dry cell seat or compartment 132 having a forward bend is positioned in the left area of the back cover plate 13 and is enclosed by a detachable shield piece 133. A through hole 134 is located at a proper place near the lower part of the back cover plate 13 corresponding to the infrared receiver 115 to help the signal receiving job executed by the receiver 115. Mounting holes 116 and 135 are provided on the circuit board 11 and the back cover plate 13 at both lateral edges respectively for assembling with the control panel 12 by set screws 136. A space is kept between the circuit board 11 and the back cover plate 13 to allow enough room for the dry cell seat 132 for receiving the dry cell after assembling with the control panel 12. The back cover plate 13 has bottom seats 137 corresponding to foot pads 125 so that the control panel device 1 can be stably laid at a suitable place. Furthermore, the scoring software card 4 is a card on which a scoring software is recorded. The scoring software can be written depending on a specific scoring way such as a score based on the difficulty of a target plate being hit, a resulting score based on a specific score subtracting scores of darts actually hitting the target plates, . . . , etc. Therefore, a variety of scoring software cards can be selected by players, that is, a choice of a specific scoring way will be achieved easily only inserting an alternative software card 4 into the card slot 111 as desired to make the changeability of playing ways possible and enhance the playing air and the amusing effect. A protection plate 121 which has a size almost the same as the opening formed by the groove on the right end plate 12c and the back cover plate 13 as the control panel device 1 is completely assembled and can be used to cover the opening to protect the software card 4.

Figure 6:
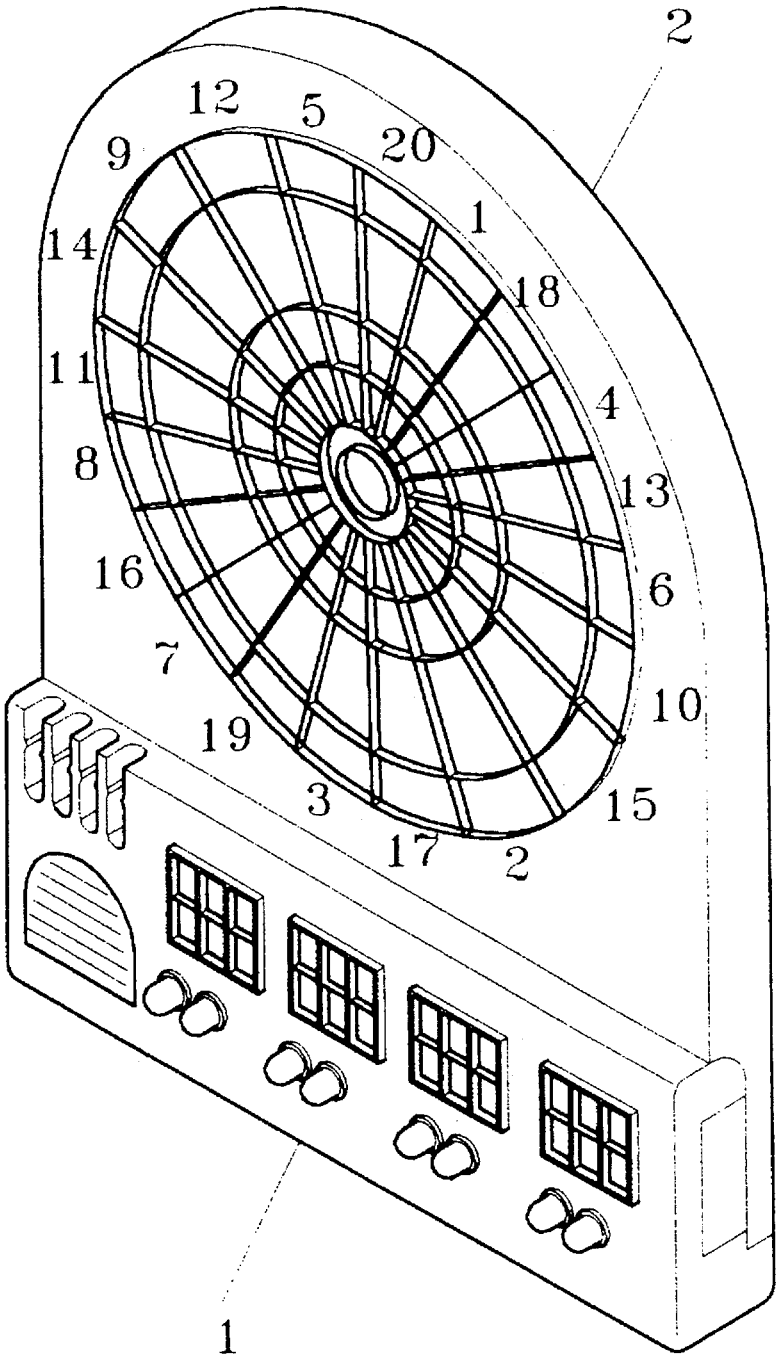
FIG. 6 is a perspective view of the dartboard portion and the control panel device which are coupled with each other to illustrate the dartboard which can be carried as a portable set.

Referring to FIG. 6, it illustrates the dartboard in a state of the dartboard portion 2 coupling with the control panel device 1 as a portable set while carrying to a playing location indoors or outdoors.

The preceding explanation is regarding to the first preferred embodiment of the invention concerning the application of infrared. The second embodiment of the invention has almost the same arrangement as the first embodiment except a minor difference which will be mentioned hereinbelow.

A transmitting circuit of radio is used instead of that of the infrared on the circuit board 22 in FIG. 2 with a wave oscillation element for sending the data signals out. A receiving circuit and a radio element are used instead of those of infrared on the circuit board 11 in FIG. 5. Furthermore, the transmitting element on the switch circuit board 22 in the dartboard portion is not provided. In short, the second embodiment of the present invention has an application of radio instead of infrared in the dartboard.

It is noted that although a dartboard according to the present invention is primarily offered for throwing darts, it is also suitable for any other shooter such as B-B bullet or the like which is capable of hitting the dartboard portion.

I claim:

1. A dartboard comprising a dartboard portion (2) and a separate control panel device (1), said dartboard portion comprising a) a front panel (21), said front panel having a plurality of annular partitions (213) and a plurality of angular spaced radial partitions (214), said annular partitions and said angular radial partitions being connected and forming a target area, said target area being filled with a plurality of target plates (215) and being surrounded by a plurality of numerical marks, b) a switch circuit board (22) having a plurality of activated switches (221) corresponding to said target plates, c) a rear cover board (23), said control panel device comprising a control panel (12) with an upper cover (12*a*) and a base cover, (12*b*), a circuit board (11), a protection plate (121) for a software card and a back cover plate (13), a circuit transmitting signals, said circuit being located on said switch circuit board (22) in said dartboard portion, a signal receiving circuit and a receiving element (115) being located on said circuit board (11) in said control panel whereby signals sent from said dartboard portion (2) are received in said control panel device, a card slot being provided on said circuit board in the control panel device for detachably locating a scoring software card, a dry cell direct current means and recharging means therefor arranged on said back cover plate, whereby said dartboard is completely portable and said control panel device being unconnected to said dartboard portion can be spatially remote therefrom, wherein said front panel (21) of said dartboard portion has a lower recess part (212) and a tongue (216) projects downwardly from said recess part (212), said upper cover (12*a*) of said control panel device has a rear edge, said rear edge having a center, a first groove (126) being located in said center, said tongue (216) being aligned with said first groove (216) whereby said dartboard portion (2) and said control panel device (1) are adapted to be coupled to form a portable panel.

2. The dartboard according to claim 1 wherein the signal transmitting circuit is a transmitting circuit of infrared and the signal receiving circuit is a receiving circuit of infrared.

3. The dartboard according to claim 1 wherein the signal transmitting circuit is a transmitting circuit of radio and the signal receiving circuit is receiving circuit of radio.

4. The dartboard according to claim 1 wherein said back cover plate (13) of said control panel device has a second central groove (131) and said tongue (216) passes through said second central groove.

5. The dartboard according to claim 1 wherein each switch (221) has a button piece (2211) and a base seat (2212), each target plate (215) has a rear surface, a clearance between said each target plate and said each button piece is provided, and when a dart hits said target plate said target plate is pushed backwardly and activates one of said switches through said button piece (2211).

6. The dartboard according to claim 1 wherein said protection plate is detachably located at a lateral end between said control panel and said back cover plate.

* * * * *